US005584400A

United States Patent [19]

Feinbloom

[11] Patent Number: 5,584,400

[45] Date of Patent: Dec. 17, 1996

[54] ADJUSTABLE LENS RACK

[75] Inventor: Richard E. Feinbloom, New York, N.Y.

[73] Assignee: Designs for Visions, Inc., Ronkonkoma, N.Y.

[21] Appl. No.: 349,044

[22] Filed: Dec. 2, 1994

[51] Int. Cl.[6] ..... A47F 7/00

[52] U.S. Cl. ..... 211/41

[58] Field of Search ..... 211/41, 175; 206/454, 206/334; 118/500

[56] References Cited

U.S. PATENT DOCUMENTS 2,121,225 6/1938 Ghrist ..... 211/41 X 4,969,560 11/1990 Stanfield ..... 211/41

5,332,105 7/1994 Stanfield ..... 211/41

*Primary Examiner*—Alvin C. Chin-Shue

*Assistant Examiner*—Sarah L. Purol

*Attorney, Agent, or Firm*—Plevy & Associates

[57] ABSTRACT

An adjustable lens rack capable of retaining a plurality of lenses of varying sizes and shapes in rows. Lenses within each row are retained within a pair of lens retaining bars which extend between two ends of a frame. At least one retaining bar is movably adjustable with respect to the other retaining bar, thus enabling retention of a different type of lens for each row. In an illustrative embodiment, each retaining bar has a plurality of channels for receiving peripheral portions of the lenses, and each retaining bar is slidably adjustable via slots in opposing ends of the frame.

19 Claims, 6 Drawing Sheets

ADJUSTABLE LENS RACK

FIELD OF THE INVENTION

This invention relates generally to lens racks and more particularly, to lens racks that are adjustable for retaining different lens sizes and shapes.

BACKGROUND OF THE INVENTION

In the high volume manufacture of lenses for eyeglasses and other products, storage racks are necessary for compact storage of the lenses prior to their final assembly to the product. A large number of lenses may be stored in racks for simultaneous cleaning via ultrasound or cleaning solvents. An "open" rack is employed for this purpose, whereupon the lenses are air dried prior to the next assembly step.

Prior art lens racks are often customized for a specific lens shape and size. As a result, a number of different customized lens racks designs are necessary to store a variety of lens types.

The cost of manufacturing these customized racks is generally substantially higher than the cost of manufacturing a single, adjustable lens rack design that can accommodate a wide variety of lens shapes and sizes. Thus, adjustable lens racks have been developed in the prior art to reduce cost and also for logistical simplicity. Many of these adjustable racks have been found to be overly complex, user-unfriendly, and unreliable.

It is therefore an object of the present invention to provide an adjustable lens rack that overcomes the above disadvantages of prior art lens racks.

It is another object of the present invention to provide an adjustable lens rack which can simultaneously store a number of lenses of diverse shapes and sizes.

SUMMARY OF THE INVENTION

The present invention is directed towards an adjustable lens rack capable of retaining a plurality of lenses of varying sizes and shapes in rows. The lenses of each row are retained between a pair of lens retaining bars that extend between two opposing ends of a frame. At least one of the lens retaining bars is movably adjustable with respect to the other, thus enabling retention of a different type of lens for each row.

In a preferred embodiment, each opposing end of the frame has a plurality of vertical slots and at least one horizontal slot above the vertical slots. Both the upper and lower retaining bars have a plurality of lens receiving channels for receiving peripheral portions of the lenses. Each channel of the lower retaining bar faces a corresponding channel of the upper retaining bar, so that each lens is retained within a corresponding pair of channels. The upper lens retaining bars are supported via the horizontal slots and are horizontally and pivotally adjustable. The lower retaining bars are supported via the vertical slots and are vertically and pivotally adjustable thereby, with the lower retaining bar channels oriented generally vertical. The upper and lower lens retaining bars are thus adjustable with respect to one another to allow any given size and shape lenses to be retained in a given row, provided that the edge thickness of the lenses are smaller than the channel widths.

Preferably, the lenses retained by the lens retaining bars of each row are further supported by a bracket/rod assembly which contacts the edges of the lenses. The bracket/rod assembly consists of a solid rectangular metallic bracket having a longitudinal semicircular cut-out, with a flexible rubber rod epoxied to the cut-out portion. The bracket portion is adjusted via the horizontal slots of the frame until the rubber rod portion contacts the lenses, securing them in place.

DETAILED DESCRIPTION OF THE PREFERRED EMBODIMENTS

Figure 1:
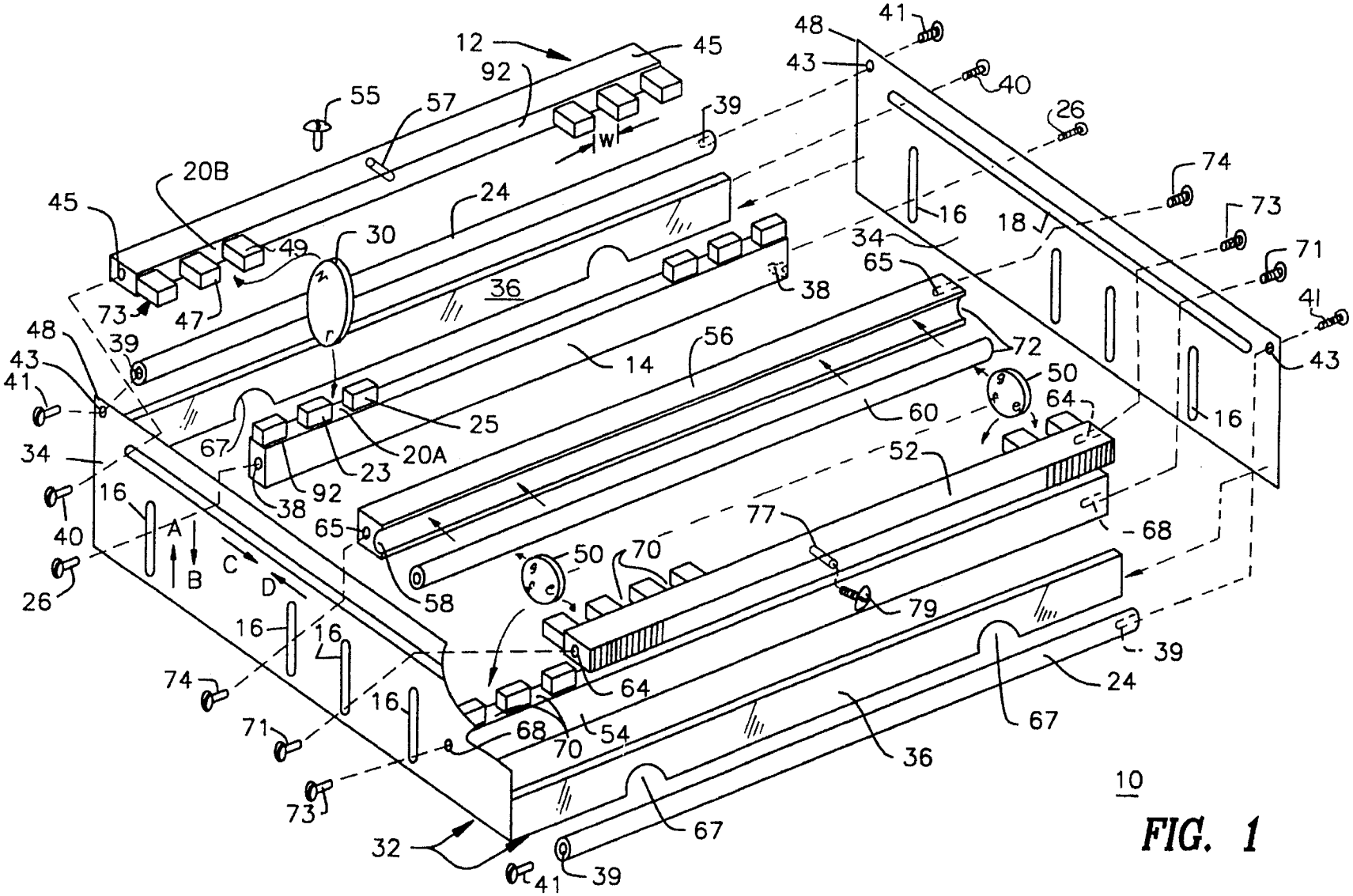
FIG. 1 is a perspective view of an adjustable lens rack according to the present invention.

Referring to FIG. 1, a first embodiment of a lens rack 10 according to the present invention includes an upper lens retaining bar 12 and a lower lens retaining bar 14. Retaining bars 12 and 14 each have a plurality of lens retaining channels such as 20A, 20B which receive peripheral portions of individual lenses 30 to be retained. Each channel is defined by two adjacent extensions on each retaining bar. Thus channel 20A of bar 14 is defined by extensions 23 and 25, and channel 20B of bar 12 is defined by extensions 47 and 49. The extensions and channels may be formed simultaneously by machining cut-outs in the retaining bars. The extensions as 23, 25 need not be of the preferred solid rectangular shape as shown. Any solid shape suitable for forming a desired channel may be employed. Moreover, the extensions as 23 and 25 may be as thick as the retaining bar, if so desired, for ease of manufacturing or otherwise. In addition, the end extensions as extension 73 of bar 12 need not be flush with the edge of the bar as shown, but could be inset a short distance from the bar edge.

Preferably, retaining bars 12 and 14 are of a solid rectangular shape and are composed of a rigid plastic material such as polysulfone, which material is suitable for contacting glass lenses with little or no scratching of the glass surfaces. Retaining bars 12 and 14 are preferably dimensioned identically to one another so that they are interchangeable. The number of lenses 30 that can be retained by a pair of retaining bars as 12, 14 with identical dimensions is determined by the number of channels per bar. The maximum edge thickness of each lens 30 retained is, of course, less than the width W of each channel. The width W is advantageously a few thousandths of an inch less than the edge thickness of the lens 30 to be retained therein such that a fit approaching an interference fit is provided.

Figure 2A:
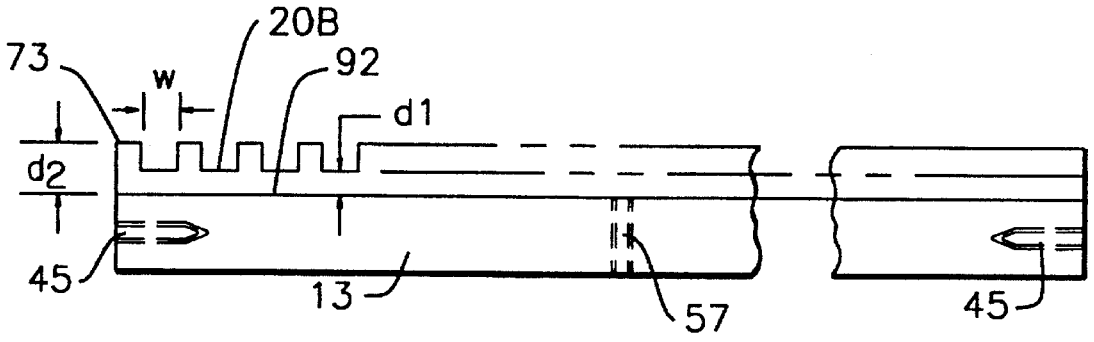
FIGS. 2A and 2B are plan and end views, respectively, of a lens retaining bar according to the present invention.
Figure 2B:
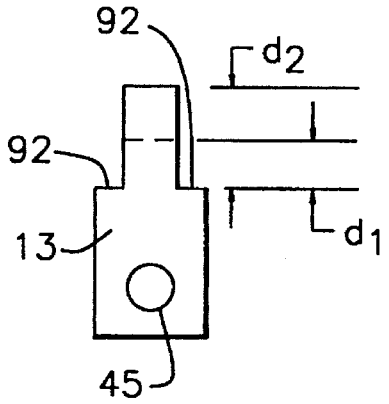

Shown in FIGS. 2A and 2B are plan and end views of a lens retaining bar 13 which can replace either of the lens retaining bars 12 or 14. Like reference numerals are used to designate similar features. Retaining bars 12, 13 and 14 each have a pair of longitudinal surfaces 92 which define the shoulders of the respective retaining bar. The distance from the bottom of each channel as 20B to the surface 92 is designated as d1; the distance from the edge of each extension as 73 is designated d2. In the retaining bars 12, 14 of FIG. 1, d1 is zero; in retaining bar 13, d1 is almost one half of d2, thus illustrating an alternate configuration for the lens retaining bars.

Retaining bars 12, 14 are mounted in a frame 32 which frame consists of two end panels 34, two lower side panels 36 and two upper side rods 24. The lower side panels 36 are welded to the bottom portions of the end panels 34. Panels 34, 36 are preferably composed of stainless steel; however, other suitable materials of metallic or rigid plastic composition may be used as well. Each panel 36 has a pair of semicircular cut-outs 67 which allow the frame 32 to be mounted on a commercial rack. Thus several lens racks 32 may be mounted on a large commercial rack for simultaneous large scale cleaning operations.

The rods 24, preferably brass, have a threaded hole 39 in each end. Each end panel 34 has two clearance holes 43, one in each upper corner, to allow screws 41 to be inserted and to screw into threaded holes 39, thereby securing the rods 24 to the end panels 34. (Only three clearance holes 43 are shown for convenience). Each end panel 34 has a number of vertical slots 16, preferably uniformly spaced from one another. A horizontal slot 18 extends substantially along the width of each panel 34, above the vertical slots 16. The lower retaining bar 14 is mounted to the two end panels 34 by means of two screws 26 which are inserted through slot 16 and screw into a threaded hole 38 in each end of the bar 14. Likewise, upper retaining bar 12 is mounted to the two end panels 34 by means of two screws 40 that pass through horizontal slot 18 and screw into a threaded hole 45 in each end. The slot 18 enables retaining bar 12 to be adjusted horizontally in directions C and D; slot 16 enables retaining bar 14 to be adjusted vertically up and down in directions A and B, respectively. In an alternate embodiment, more than one horizontal slot in each end panel 34 can be employed.

Retaining bars 12 and 14 are also pivotally adjustable. Thus, the extensions as 23, 25 of retaining bar 14 need not be oriented vertically as shown. For instance, retaining bar 14 may be pivoted towards the upper left hand corners 48 of the end panels 34. Likewise, the extensions such as 47 and 49 of the upper retaining bar 12 need not be oriented horizontally. Bar 12 may be pivoted up or down to achieve an orientation other than horizontal.

The vertical, horizontal and pivotal adjustment capability allows the relative positions of the retaining bars 12 and 14 to be optimized to retain a given size and shape lens 30 between corresponding pairs of channels such as 20A, 20B. For instance, the bar orientations may be varied to accommodate elliptical or rectangular shaped lenses rather than the circular shaped lens 30. Adjustment of the bars 12, 14 may be accomplished manually, whereupon the screws 26 and 40 are tightened, preferably using lock washers (not shown), to secure the desired positions of the retaining bars.

Each pair of upper and lower lens retaining bars retains a row of lenses of the same size and shape. The use of a number of vertical slots 16 in conjunction with the elongated horizontal slot 18, allows several pairs of upper and lower retaining bars to be included within the rack 10. Shown in FIG. 1 is another upper lens retaining bar 52 and lower lens retaining bar 54 which operate as a pair to retain lenses such as 50. The lens 50 may be of a different size and shape than the lens 30. The size of the channels 70 of the retaining bars 52, 54 are designed to accommodate a given lens edge thickness. Screws 73 and 71 are inserted through the slots 16 and 18, respectively and screw into respective threaded holes 68, 64 at each end of the retaining bar 54, 52 to secure bars 54, 52 to the end panels 34. Thus retaining bar 54 is vertically and pivotally adjustable; retaining bar 52 is horizontally and pivotally adjustable. A screw 79 is partially screwed into the threaded hole 77 which is centrally located on the retaining bar 52. The head of the screw 79 can then be adjusted to make contact with the side rod 24 when the retaining bar 52 is in its final position, thereby adding support to the retaining bar 52.

Figure 3A:
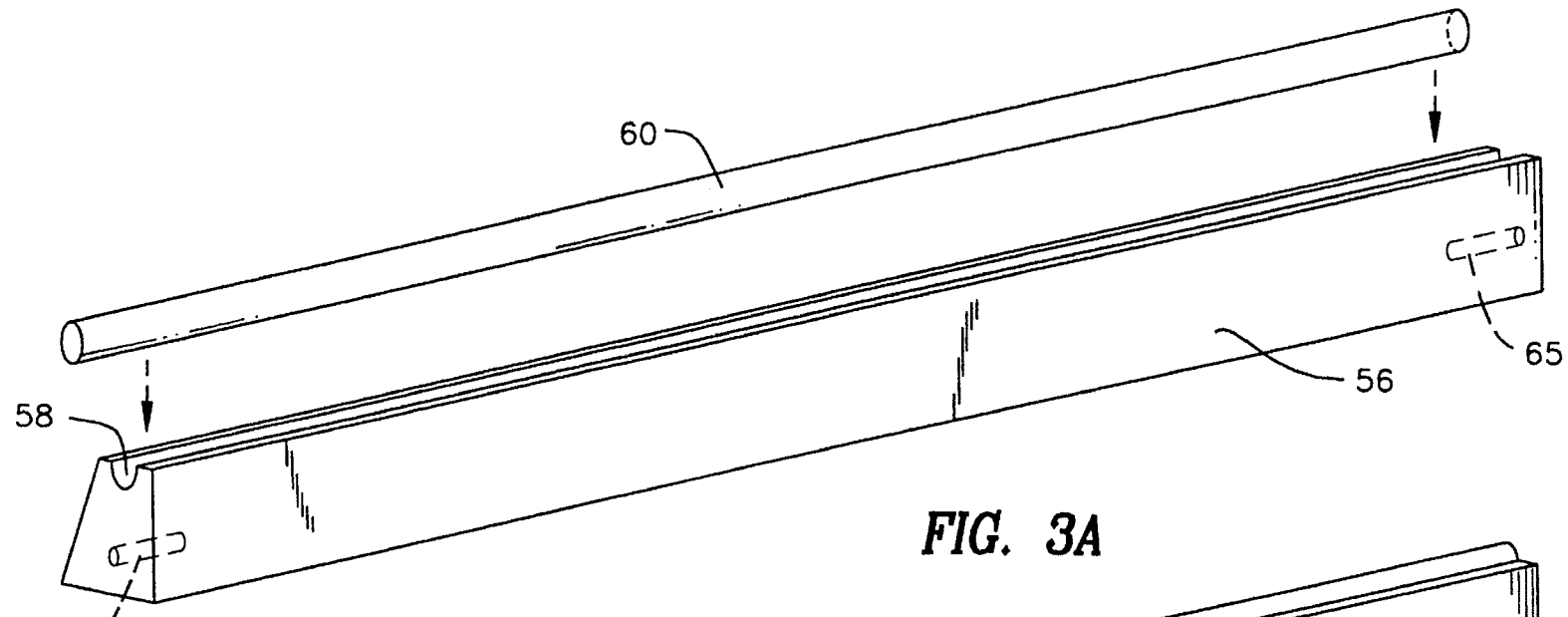
FIGS. 3A and 3B are perspective views of the bracket/rod assembly of the present invention.
Figure 3B:
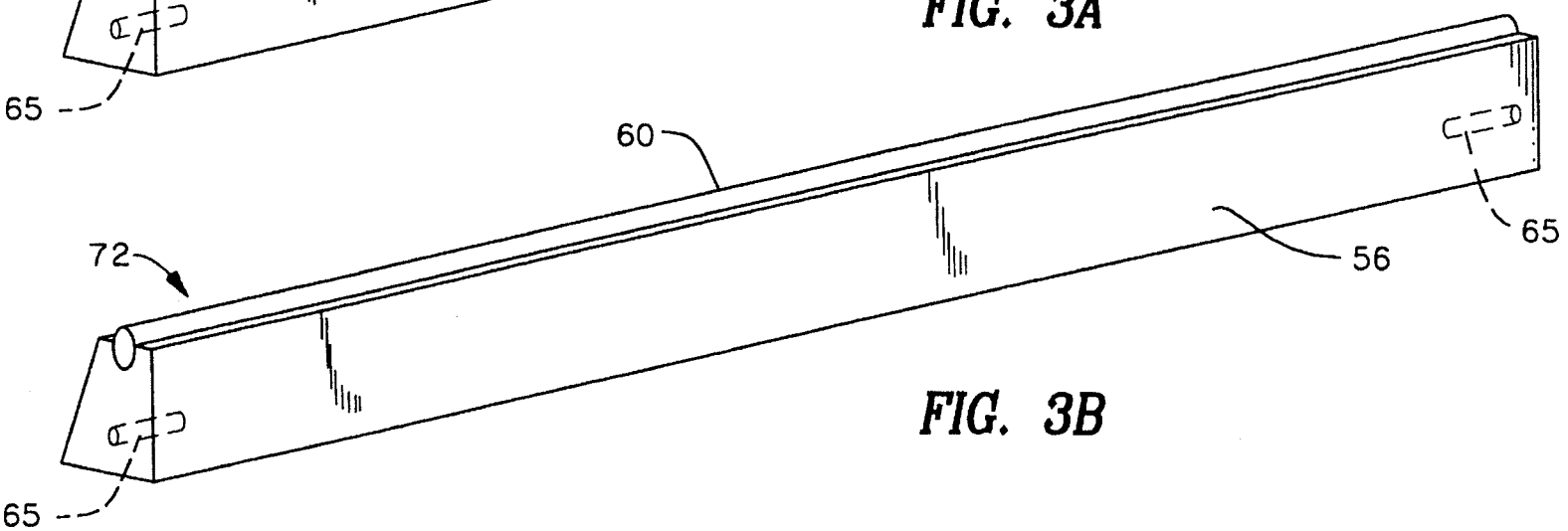

A row of lenses 50 can be retained solely by virtue of contact with the corresponding pairs of channels 70 of the retaining bars 52 and 54 at two peripheral portions, e and f, of each lens 50, similar to the above described retention of lenses 30 at two peripheral portions q and r. Preferably, however, a lens retaining bracket 56 is provided to more securely hold the lenses 50 in place. Retaining bracket 56, which is preferably aluminum, has a longitudinal semicircular cut-out 58 extending along its entire length. The dimensions of the cut-out 58 are tailored to fit a rod 60 which is epoxied thereto. This is illustrated in FIGS. 3A and 3B. The rod 60 is preferably rubber to provide a flexible cushion against the edges of the lenses contacted, but could alternatively be composed of a suitable flexible plastic. The cut-out 58 is designed so that the rod 60 protrudes from the bracket 56 when epoxied thereto, as seen in FIG. 3B. The assembly of the rod 60 to the bracket 56 is designated the bracket/rod assembly 72. Referring again to FIG. 1, the bracket/rod assembly 72 is mounted to the end panels 34 by means of two screws 74 which are inserted through the horizontal slots 18 into threaded holes 65. The bracket rod assembly 72 is thus horizontally adjustable, and can also be pivotally adjusted if so desired. The assembly 72 is preferably adjusted to contact the lenses 50 after the positions of the lens retaining bars 52 and 54 have been finalized and the lenses 50 placed in their respective channels 70. The protruding portion of the rod 60 contacts each lens 50 at a third contact point "g". The advantage of composing the rod 60 out of flexible rubber is apparent when considering that the lenses 50 and channels 70 can not be identically dimensioned due to tolerance errors. Adequate contact with each of the lenses 50 is nevertheless assured as the rod 60 flexes locally when pushed against the row of lenses 50 positioned within the channels 70. To remove the lenses 50 from the rack 10 after a cleaning operation or otherwise, the screws 74 are loosened and the assembly 72 is slid away to readily access the lenses 50 for removal.

It should be understood that a bracket/rod assembly such as 72 can be used with each pair of upper and lower lens retaining bars to provide further support for each row of stacked lenses. Thus in FIG. 1, another bracket/rod assembly 72 could be secured to the end panels 34 via the slots 18 to further secure the row of lenses 30. The diameter of the semicircular cut-out 58 and rod 60 may be varied if so desired to optimize the support for given lens sizes and types.

Figure 4A:
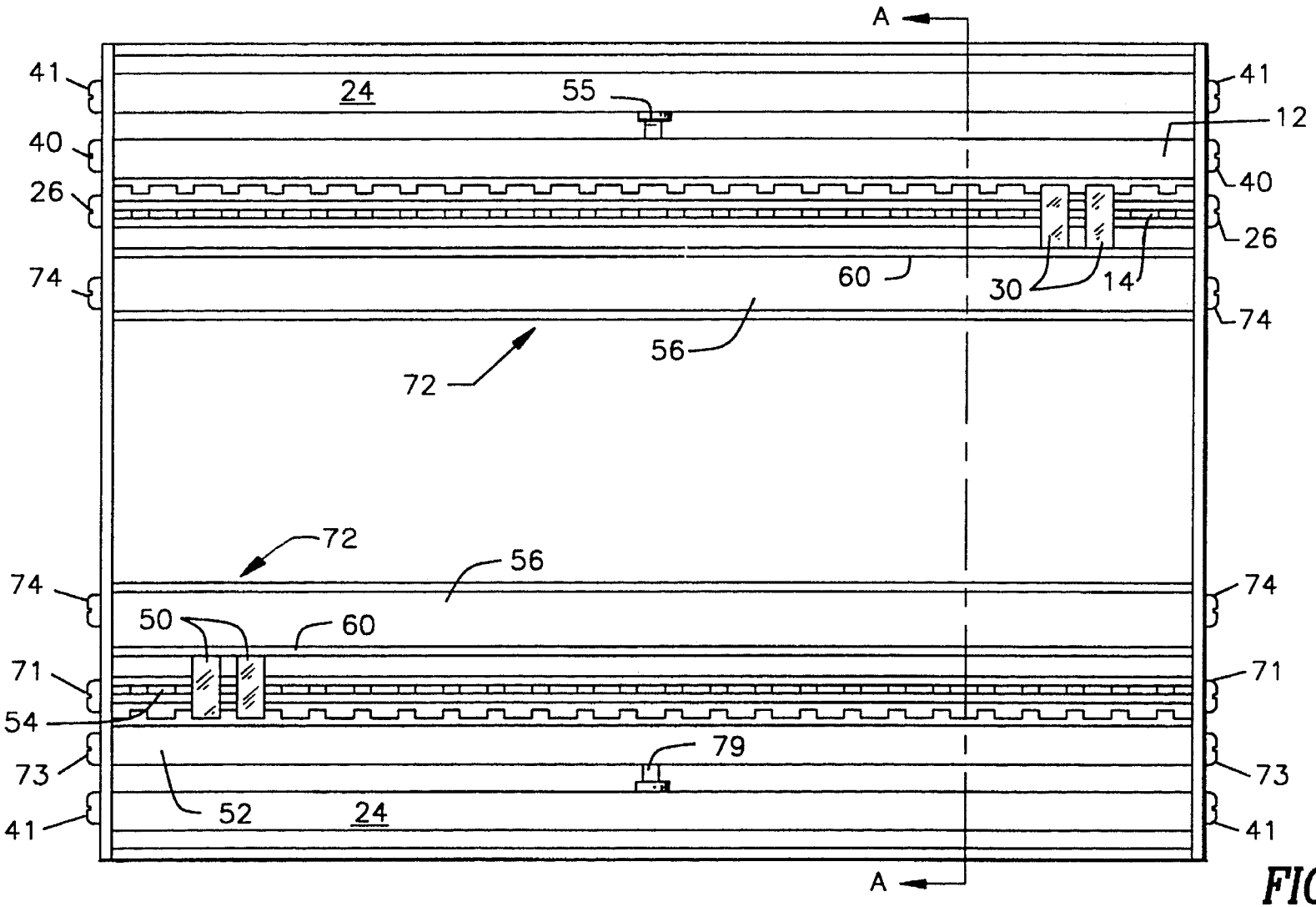
FIG. 4A is a plan view of the lens rack illustrated in FIG. 1.
Figure 4B:
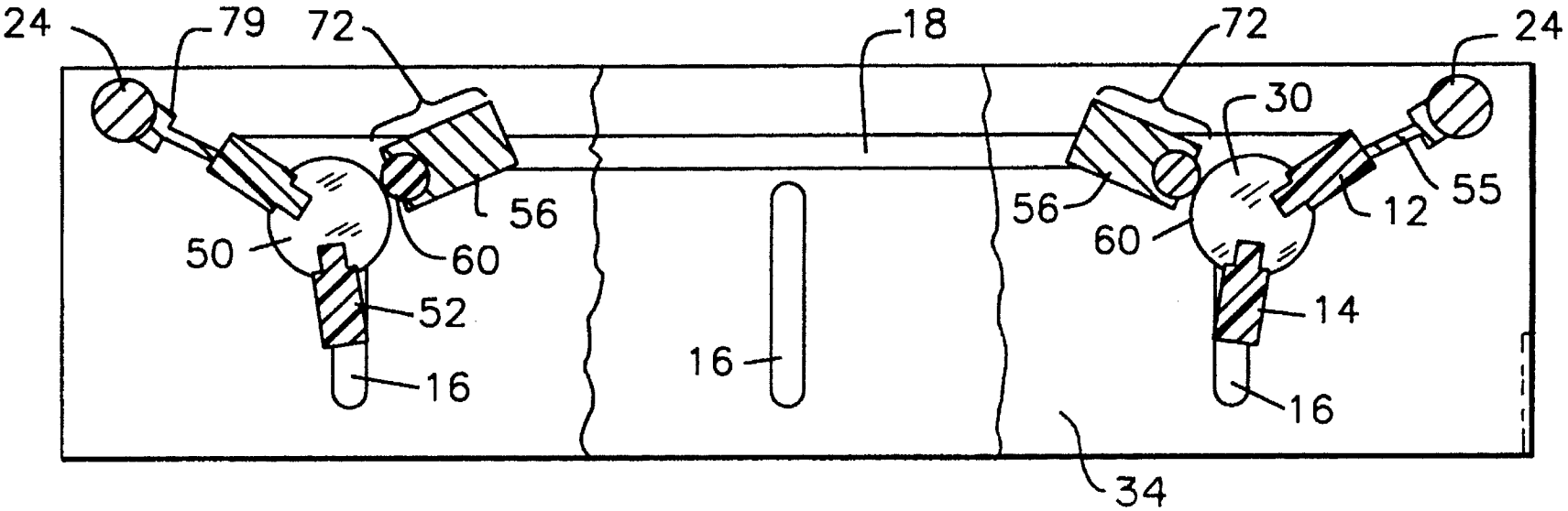
FIG. 4B is the cross-sectional view A-A of the lens rack of FIG. 4A.

FIGS. 4A and 4B show plan and cross-sectional views, respectively, of the rack 10 of FIG. 1 in order to further illustrate the physical and functional relationships among the various components. A second bracket/rod assembly 72 is employed to provide cushion support for the lenses 30 retained within the channels of lens retaining bars 12 and 14. Two lenses 50 are shown in FIG. 4A being retained within adjacent channels 70 of the retaining bars 52 and 54. The rod 60 of the bracket/rod assembly 72 is shown contacting each lens 50 for further support. The upper retaining bars 12 and 52 and bracket/rod assemblies 72 are each pivoted downward from the horizontal position, as is readily seen from the cross-sectional view of FIG. 4B. The lower retaining bars 14 and 54 are similarly shown pivoted slightly from the vertical position. In addition, the screw heads of the screws 79 and 55 are shown abutting the rod 24 to provide additional support to the retaining bars 52 and 12, respectively. Once the positions of the retaining bars 12 and 52 are determined, the screws 73 and 40 are tightened, and then the hexagonal head of the screws 55 and 79 are tightened against the rods 24 to further secure the final positions of the upper lens retaining bars.

Figure 5:
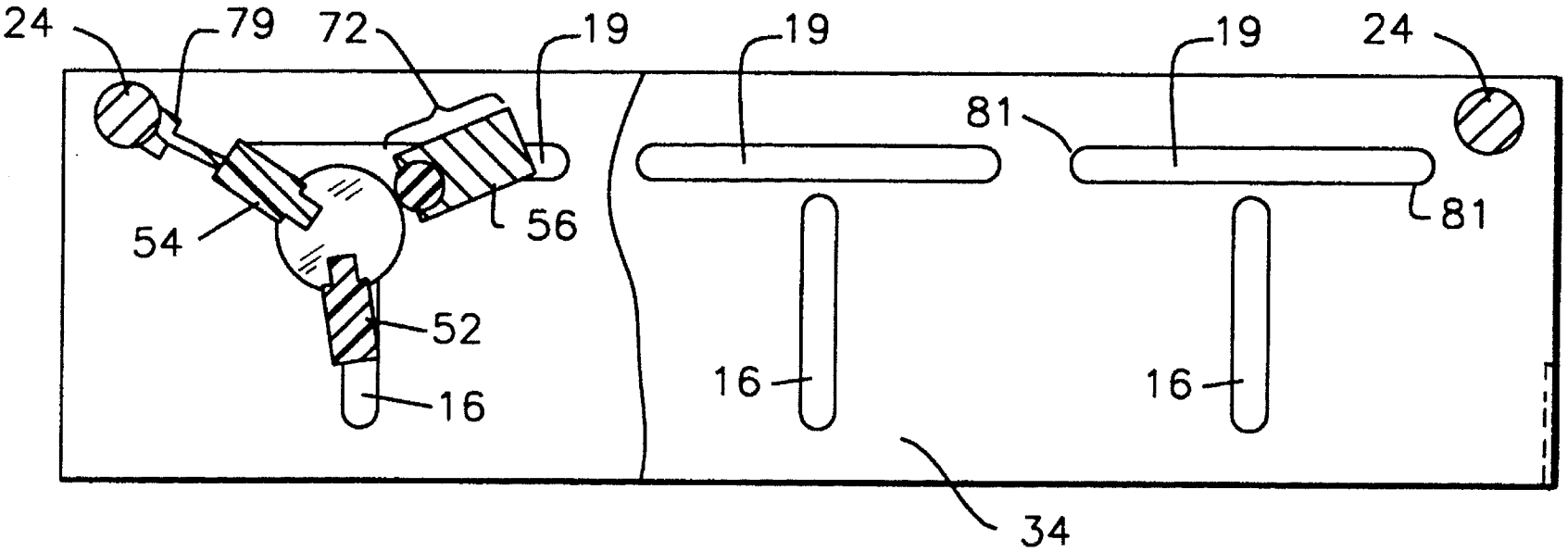
FIG. 5 illustrates an alternate embodiment of the lens rack according to the present invention.

In an alternate configuration, the elongated horizontal slot 18 is replaced by a number of adjacent horizontal slots 19, as illustrated in FIG. 5. (FIG. 5 is otherwise the same as FIG. 4B with the lens retaining bars 12, 14 and associated bracket/rod assembly 72 removed for illustration purposes). Each slot 19 may be associated with a given pair of upper and lower retaining bars as 52, 54 and optional bracket/rod assembly 72, which retain a given row of lenses. Each slot 19 has a pair of edges 81 which allow the screws such as 73 and/or 74 to be banked against during the adjustment process, thereby serving as "stops". In another arrangement, the bracket/rod assembly 72 can be mounted through an adjacent slot 19 to the one that the upper retaining bar 52 is mounted through. Thus, if three slots 19 are employed—i.e., two end slots 19 and a center slot 19—the retaining bar 54 can be mounted through the end slot while the bracket/rod assembly 72 is mounted through the center slot 19.

From the foregoing, thus disclosed is an adjustable lens rack in an open configuration, particularly suited for retaining lenses during lens cleaning operations. Advantageously, the lens rack according to the invention includes upper and lower adjustable lens retaining bars which enable lenses of various sizes and shapes to be retained in rows. Each row is allocated to a given lens type at any given time. In a preferred embodiment, a bracket/rod assembly with a flexible rubber rod is employed to further support the lenses. Each lens is then advantageously retained by means of contact at three selected peripheral locations on the lens.

It will be understood that the embodiments described herein are merely exemplary and that a person skilled in the art may make many variations and modifications without departing from the spirit and scope if the invention. For example, the rack according to the invention may be modified to allow adjustment of only the upper or lower lens retaining bars, rather than affording adjustment capability for both as described above. All such modifications are intended to be included within the scope of the invention as defined by the appended claims.

What is claimed is:

1. An adjustable lens rack for retaining a plurality of lenses, comprising:

a frame having a first end and a second opposing end, each of said ends having a length and width;

a first pair of parallel slots, one slot disposed along the length of the first end of said frame and the other slot disposed along the length of said second end of said frame;

a second pair of parallel slots, one slot disposed along the width of the first end of said frame and the second slot disposed along the width of said second end of said frame, at least two lens retaining bars for retaining said lenses therebetween, each said lens retaining bar extending from said first end to said second end of said frame, first means for slidably adjusting said first lens retaining bar along said first pair of slots;

second means for slidably adjusting said second lens retaining bar along said second pair of slots;

whereby said first and second lens retaining bars can be selectively positioned with respect to one another to enable lenses of varying sizes and shapes to be retained therebetween.

2. The lens rack according to claim 1 wherein each of said lens retaining bars has a plurality of lens receiving channels for receiving peripheral portions of said lenses, and wherein orientation of the channels of a first of said two lens retaining bars is adjustable with respect to the channels of a second of said two lens retaining bars, each said lens thereby being retained within a pair of channels, said pair consisting of a channel of said first retaining bar and a corresponding channel of said second retaining bar.

3. The lens rack according to claim 2, further comprising bracket means extending between said first end and second ends of said frame for contacting each of said lenses retained within a pair of said channels, thereby securing said lenses retained therein.

4. The lens rack according to claim 3 wherein said bracket means comprises a generally solid rectangular member having a longitudinal semicircular cut-out defining a longitudinal surface; and a cylindrical rubber rod affixed to said longitudinal surface defined by said cut-out;

whereby said rubber rod contacts said lenses to secure said lenses retained within said channels.

5. The lens rack according to claim 4 further including retaining means for retaining said bracket means to said frame via said first slot, said bracket means being slidably adjustable along said first slot thereby enabling said rod to contact lenses of varying sizes.

6. The lens rack according to claim 4 further including retaining means for retaining said bracket means to said frame substantially parallel to said first lens retaining bar, and wherein said frame includes another pair of slots substantially perpendicular to said second pair of slots, said bracket means being slidably adjustable along said another pair of slots thereby enabling said rod to contact lenses of varying sizes.

7. The lens rack according to claim 2 wherein said first and second lens retaining bars have substantially identical dimensions.

8. The lens rack according to claim 2 wherein said first and second lens retaining bars are polysulfone.

9. The lens rack according to claim 2, further comprising:

a third lens retaining bar having a third plurality of channels;

a fourth lens retaining bar having a fourth plurality of channels;

said frame further including a third pair of slots consisting of a third slot on said first end and a third opposing slot on said second end parallel to said third slot, said third pair of slots being substantially parallel to said second pair of slots;

retaining means for retaining said third lens retaining bar to said frame via said third pair of slots, said third lens retaining bar being slidably adjustable along said third pair of slots;

retaining means for retaining said fourth lens retaining bar to said frame via said first pair of slots, said fourth lens retaining bar being slidably adjustable along said first pair of slots;

wherein said third and fourth lens retaining bars are selectively positioned with respect to one another to enable lenses of varying sizes and shapes to be retained between said third and fourth plurality of channels thereof;

whereby said first and second retaining bars retain a first plurality of lenses of a first size and a first shape in a first row, and said third and fourth lens retaining bars retain a second plurality of lenses of a second size and a second shape in a second row.

10. The lens rack according to claim 9 wherein said second size is different than said first size.

11. The lens according to claim 9 wherein said third plurality of channels is equal to said fourth plurality of channels, and said third plurality of channels is unequal to said plurality of channels of said first lens retaining bar, whereby a different number of lenses can be retained in said second row than in said first row.

12. The lens rack according to claim 2 wherein each of said first and second retaining bars comprise a generally solid rectangular member with a plurality of solid rectangular extensions which define said plurality of channels therein.

13. The lens rack according to claim 1, wherein said frame comprises:

said first end and second ends comprising respective first and second end panels each said end panel having a first end and a second end, a lower portion and an upper portion;

first and second side panels joining said first ends of said end panels to one another and said second ends of said end panels to one another at said lower portions of said end panels; and first and second cylindrical rods joining said first ends of said end panels to one another and said second ends of said end panels to one another at said upper portions of said end panels for adding support to said frame.

14. The lens rack according to claim 13 wherein said end panels are welded to said side panels and further including retaining means to retain said rods to said end panels.

15. The lens rack according to claim 13 wherein a threaded hole is formed in a central portion of said first lens retaining bar;

said lens rack further including screw means having a threaded portion and a head portion, and wherein said threaded portion is partially screwed into said threaded hole such that said head portion contacts one of said cylindrical rods, thereby adding support to said first lens retaining bar when the lenses are retained within the rack.

16. The lens rack according to claim 2 wherein said first and second lens retaining bars are pivotally adjustable to optimize retention of the lenses.

17. An adjustable lens rack for retaining a plurality of lenses in a plurality of rows with each row containing lenses of the same type, said lens rack comprising:

an open frame having a first end and a second opposing end, each said end having a plurality of vertical slots and at least one horizontal slot above said vertical slots;

a plurality of upper lens retaining bars, each extending from said first end to said second end of said frame, and each having a plurality of channels for receiving peripheral portions of said lenses;

a plurality of lower lens retaining bars, each extending from said first end to said second end of said frame and each having a plurality of channels for receiving peripheral portions of said lenses, wherein each channel of said lower retaining bar faces a corresponding channel of one of said upper lens retaining bars;

a plurality of bracket means for contacting edges of said lenses when said lenses are retained within said lens retaining bars, each said bracket means extending from said first end to said second end of said frame;

wherein said lower retaining bars are supported via said vertical slots and are thereby slidably adjustable vertically, said upper retaining bars and said bracket means are supported via said horizontal slots and are thereby slidably adjustable horizontally, such that each row of lenses is retained by one of said upper lens retaining bars, one of said lower lens retaining bars and one of said bracket means.

18. The lens rack according to claim 17 wherein each of said bracket means comprises:

a generally solid rectangular member having a longitudinal circular cut-out defining a surface;

a cylindrical rubber rod affixed to said surface defined by said cut-out;

whereby said rubber rod contacts said edges of said lenses to secure said lenses retained within said channels.

19. The lens rack according to claim 17 wherein each of said channels have widths corresponding substantially to the edge thicknesses of the lenses retained therein.

* * * * *